US009560452B2

(12) United States Patent
Goller

(10) Patent No.: US 9,560,452 B2
(45) Date of Patent: Jan. 31, 2017

(54) CONE TWEETER MEMBRANE

(76) Inventor: Lars Goller, Herning (DK)

( * ) Notice: Subject to any disclaimer, the term of this patent is extended or adjusted under 35 U.S.C. 154(b) by 727 days.

(21) Appl. No.: 12/670,220

(22) PCT Filed: Jul. 25, 2008

(86) PCT No.: PCT/DK2008/000280

§ 371 (c)(1),
(2), (4) Date: Jan. 14, 2011

(87) PCT Pub. No.: WO2009/102783

PCT Pub. Date: Jan. 29, 2009

(65) Prior Publication Data

US 2011/0158463 A1 Jun. 30, 2011

(30) Foreign Application Priority Data

Jul. 25, 2007 (DK) ..... 2007 01094

(51) Int. Cl.
*H04R 7/00* (2006.01)
*H04R 7/12* (2006.01)

(52) U.S. Cl.
CPC ..... *H04R 7/127* (2013.01)

(58) Field of Classification Search
CPC ..... H04R 1/30; H04R 1/2861; H04R 1/2865; H04R 2201/34; H04R 9/00; H04R 29/003; H04R 2209/00; H04R 2209/41; H04R 9/025; H04R 9/027; H04R 7/00; H04R 2207/00; H04R 7/06; H04R 7/12–7/127
USPC ..... 381/340, 343, 400, 412, 423–424, 430
See application file for complete search history.

(56) References Cited

U.S. PATENT DOCUMENTS

| | | | | |
|---|---|---|---|---|
| 2,003,908 | A * | 6/1935 | Smith | 381/430 |
| 3,033,945 | A * | 5/1962 | Villchur | 381/413 |
| 3,496,307 | A * | 2/1970 | Sotome | 381/420 |
| 3,935,400 | A * | 1/1976 | Koga | 381/430 |
| 4,297,537 | A * | 10/1981 | Babb | 381/189 |
| 4,440,983 | A * | 4/1984 | Facoetti et al. | 381/190 |
| 5,150,419 | A * | 9/1992 | Kizak et al. | 381/412 |
| 5,933,508 | A * | 8/1999 | Fuke et al. | 381/343 |
| 6,320,970 | B1 * | 11/2001 | Czerwinski et al. | 381/343 |
| 6,320,972 | B1 * | 11/2001 | Goller | 381/430 |
| 8,131,005 | B2 * | 3/2012 | Lemarquand | H04R 9/027 381/362 |

* cited by examiner

*Primary Examiner* — Suhan Ni
(74) *Attorney, Agent, or Firm* — Michael P. Kochka, Esq.

(57) ABSTRACT

Membrane construction for a loudspeaker, in particular a cone tweeter membrane construction, where said membrane comprises two concentrically arranged sections, a first inner dome shaped annular membrane section connected or integral with a second outer cone shaped membrane section, where the outer section comprises means for attaching a surround.

4 Claims, 2 Drawing Sheets

CONE TWEETER MEMBRANE

FIELD OF THE INVENTION

The present invention discloses a membrane construction for a loudspeaker and in particular a cone tweeter membrane construction.

BACKGROUND OF THE INVENTION

Cone tweeters are a particular type of loudspeaker components, which are usually used in order to emit sound in the high frequency area. This in contrast to for example loudspeakers in the low frequency area requires that the loudspeaker is able to move very fast and may be exposed to relatively high loads in order to provide a balanced overall sound reproduction in co-operation with other loudspeaker units.

OBJECT OF THE INVENTION

It is an object of the present invention to provide a cone tweeter membrane with improved characteristics, which in addition to being able to reproduce sound in the high frequency area with less distortion is able to do this at higher effects i.e. when the load on the loudspeaker is increased.

The invention addresses this by providing a membrane construction for a loudspeaker, in particular cone tweeter membrane construction, where said membrane comprises two concentrically arranged sections, a first inner dome shaped annular membrane section connected or integral with a second outer cone shaped membrane section, where the outer section comprises means for attaching a surround.

Traditionally cone tweeters are provided with a cone-shaped membrane and a dust plug arranged in the centre, in that cone-shaped membranes have a relatively high inherent strength in that the load on the membrane in addition to being along a symmetry axis substantially perpendicular to the membrane's plane, the forces imparting the membrane are transmitted in the same plane as the membrane i.e. parallel to the membrane surface.

Traditionally loudspeakers of this type operate by having a voice coil arranged in an air gap where the air gap is provided in a magnet construction such that the voice coil is arranged in a magnetic field. By alternating the current in the voice coil the magnetic field will urge the coil to move in the magnetic field depending on the direction of the current. This is a typical driver (or motor) construction for a loudspeaker. When the membrane is attached to the voice coil, the movement of the coil will be transmitted to the membrane, which thereby will generate the sound.

In the high frequency area, as already mentioned above, the generation of the sounds requires the membrane to move back and forward very rapidly, which again puts severe loads on the membrane construction as such. This traditionally requires the tweeter construction to be relatively small, which again has limited the ability to transmit enough power such that loudspeakers at this type at high loads have had a tendency to distort the sound, which again has a detrimental effect on the overall reproduction of the sound emitted from the loudspeaker assembly.

By utilizing the strength characteristics of a cone-shaped membrane in combination with a inner dome shaped annular membrane the effective area of the cone tweeter membrane construction is increased in such a way that a higher output is achieved, not only relating to power but also the frequency span of the cone tweeter is increased. Furthermore, the inner dome shaped annular membrane section also provides for a better distribution of the generated sound, in that the dome shaped annular section provides for a sound distribution without interference from other surfaces in the loudspeaker such that a clear and relatively loud sound may be emitted.

In a further advantageous embodiment, a voice coil by means of a voice coil cylinder is attached to the membrane between the first and second sections.

The arrangement of the voice coil cylinder in this position makes it possible to use a rather large diameter voice coil such that more coils will be present in a larger magnetic field whereby it becomes possible to transfer more power to the membrane construction as such.

In a further advantageous embodiment the voice coil is guided and sideways maintained for linear movement in a direction parallel to an imaginary axis of symmetry through the central portion of the membrane, by the first inner dome shaped annular membrane section. Due to the geometric configuration of the inner dome shaped annual membrane in corporation with the cone shaped membrane section, the voice coil is guided and maintained substantially in the same position relative to the driver and the chassis whereby further coil guiding means are not needed. Traditionally a spider will be provided in order to maintain the voice coil in proper relationship or position with respect to the air gap, but due to the inventive membrane construction this may be alleviated. This in turn again provides advantages in that less mass has to be moved back and forth i.e. accelerated by the loudspeaker driver. This again increased the output power of the tweeter and limits the mechanical impact on the membrane such that less distortion and undesirable sound effects will arise during use.

In a still further advantageous embodiment of the invention, the inner dome shaped annular membrane is fastened along the outer periphery to the voice coil cylinder, and centrally to a tower being connected to a central part of the driver of the loudspeaker.

The tower construction facilitates a firm connection between the inner dome shaped annular membrane section and at the same time allows this section to move due to the action of the voice coil such that a relatively ridged and very strong construction is provided.

In a still further advantageous embodiment the tower is provided with a cavity, in which cavity an adhesive is arranged, which adhesive connects the membrane to the tower, where said adhesive exhibits plastic or resilient properties. The adhesive connection being resilient will have a dampening effect on the membrane whereby undesired membrane phenomena such as wobbling, radial wave propagation, resonances etc. is greatly reduced which again improves the overall performance of the cone tweeter membrane construction.

The plastic or resilient properties of the adhesive may naturally be chosen according to the circumstances such that the most appropriate characteristics of the adhesive are selected in order both to address the need to firmly attach and maintain the inner dome shaped annular membrane section in a reliable relationship with the tower construction and at the same time allow for the flexibility and elasticity necessary in order to achieve the desired dampening effects.

Alternatively to be attached by adhesive means the inner dome shape annual membrane may be fastened to the tower construction by mechanical means as specified in a further advantageous embodiment of the invention. The mechanical means may comprise a plug construction fastened through the membrane to the tower such that on the visible side of the cone tweeter membrane, the membrane as such and a sound plug may be visible where the sound plug is connected to the tower construction.

The invention is furthermore directed to a tweeter cone transducer incorporating an inventive membrane construction and fastening method according to the invention, as specified in further claims.

DESCRIPTION OF THE DRAWING

The invention will now be explained with reference to the accompanying drawing, which illustrates a cross section through a loudspeaker in which loudspeaker a membrane according to the present invention has been arranged.

DETAILED DESCRIPTION OF THE INVENTION

Figure 1:
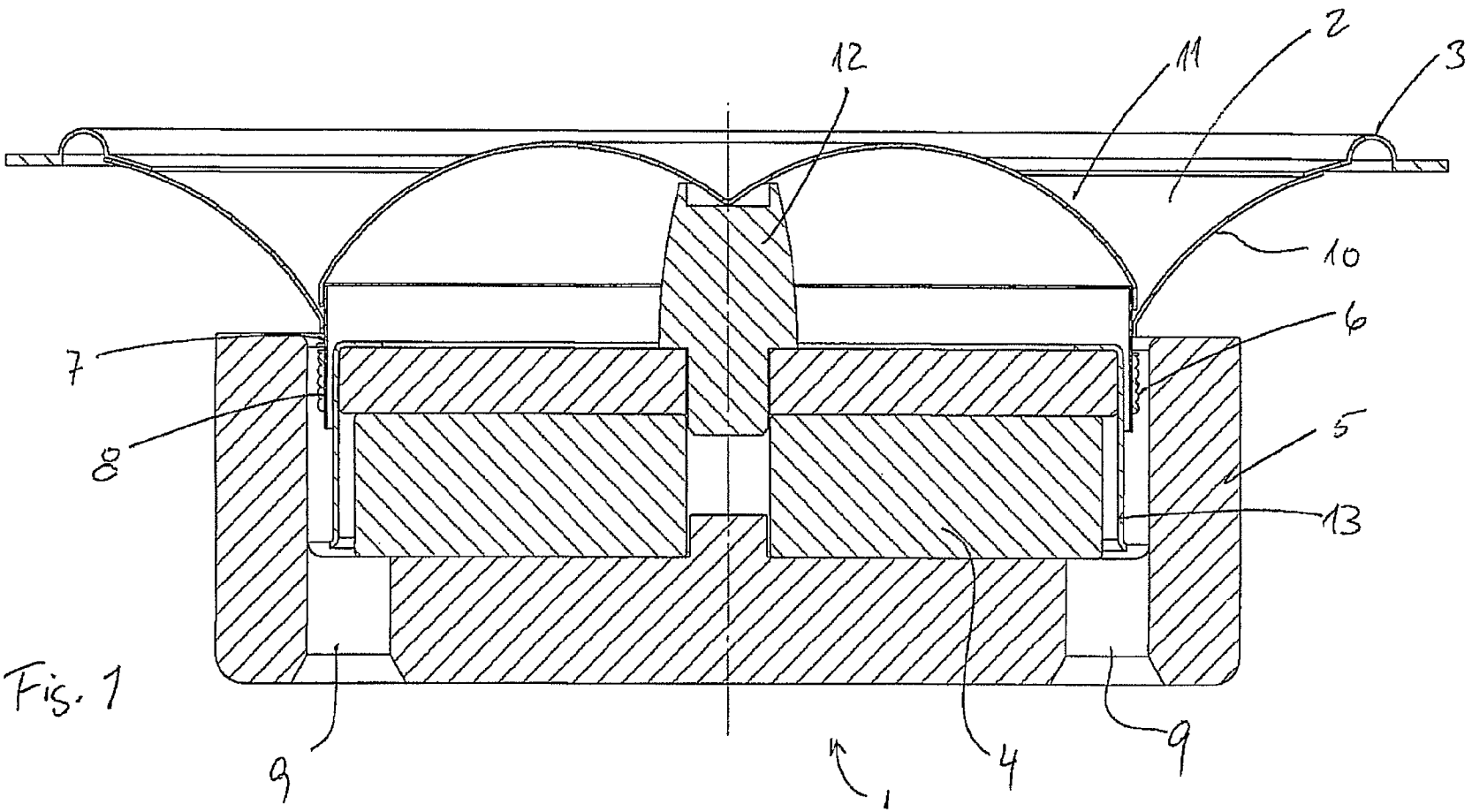
In FIG. 1 a first embodiment of the invention is illustrated, where the central portion of the membrane is adhesively fastened to the tower.

In FIG. 1 a cross section through a first embodiment of the invention is illustrated. The cross section through a cone tweeter loudspeaker construction is illustrated however, the load bearing chassis, which is also used to mount the cone tweeter, has been left out for clarity reasons. The loudspeaker construction traditionally comprises a driver 1, a membrane 2 and a surround 3, for fastening the membrane to the not illustrated chassis.

The driver 1 usually comprises a number of magnets 4,5 which are arranged such that an air gap 6 is provided. The magnets are arranged such that a magnetic field will be present across the air gap where the flux lines are arranged and designed to be substantially linear across the air gap 6. The membrane construction 2 further comprises a voice coil cylinder 7 on which cylinder a voice coil 8 is arranged. When changing the direction of the current in the voice coil the voice coil and thereby the voice coil cylinder will be forced to move up and down relative to the magnetic flux according to basic electrical laws.

As the voice coil cylinder is attached to the membrane 2, the membrane will move accordingly and generate a sound output.

The membrane according to the present invention is made from two geometrically different membrane parts 10,11 where an outer part has a cone shape and an inner part has an inner dome shape annular shape. By combining these two geometrical shapes, a number of advantages are achieved.

The inner dome shape annular membrane section 11 is along an outer periphery fastened to the voice coil cylinder 7. Centrally the dome shape is fastened to a tower 12, which projects from the driver 1. The fastening of the inner section 11 to the tower and its circular dome shaped configuration creates a relatively stabile guidance and positioning of the voice coil cylinder 7 in relation to the air gap 6. This positioning is further enhanced by the outer cone shaped membrane section 10, which is also fastened to the voice coil cylinder 7 such that the voice coil cylinder 7 is geometrically fixated by the two membrane sections 10,11 in the air gap 6. The relative stable fixation of the voice coil cylinder in relation to the air gap by the two membrane section 10,11 makes is possible to avoid the use of the traditional spider whereby a simple mechanical system is provided.

In the illustrated embodiments a copper cap 13 is illustrated in the air gap. Traditionally the copper caps are introduced in order to minimize the induction created by the coil's movements in the air gap. Obviously the system will also work without this copper cap 13.

The copper cap also functions as a heat conductor, conducting generated heat from the air gap away, thereby maintaining optimum working temperature around the magnets and the air gap.

The geometrical shapes of the membrane 2, i.e. the cone section 10 and the dome shape section 11 supplement each other such that a larger sound transmission area is provided in that the dome shaped inner section 11 is able to emit sound over its entire area with substantially no interference from either of the domes or from the cone shape section 10 of the membrane. Furthermore, as opposed to traditional cone tweeters a dust cap in the middle is avoided, which again provides for more effective area of the membrane 2 as such.

The air gap 6 has been arranged at a larger radius than what is normal whereby a larger size voice coil 8 is provided, which again makes it possible to transmit more force, relative to weight to the membrane construction 2 in relation to a smaller radius voice coil. This is due to the fact that more flux lines are able to be arranged in the air gap due to the larger size of the air gap, whereby the influence on the voice coil 8 may be increased.

In order to provide for ventilation, apertures 9 are provided towards the rear of the unit such that any air pressure, which might build up behind the membrane 2 may be evacuated through the ventilation apertures 9, whereby no air pressure will hamper the movement of the membrane 2.

Figure 2:
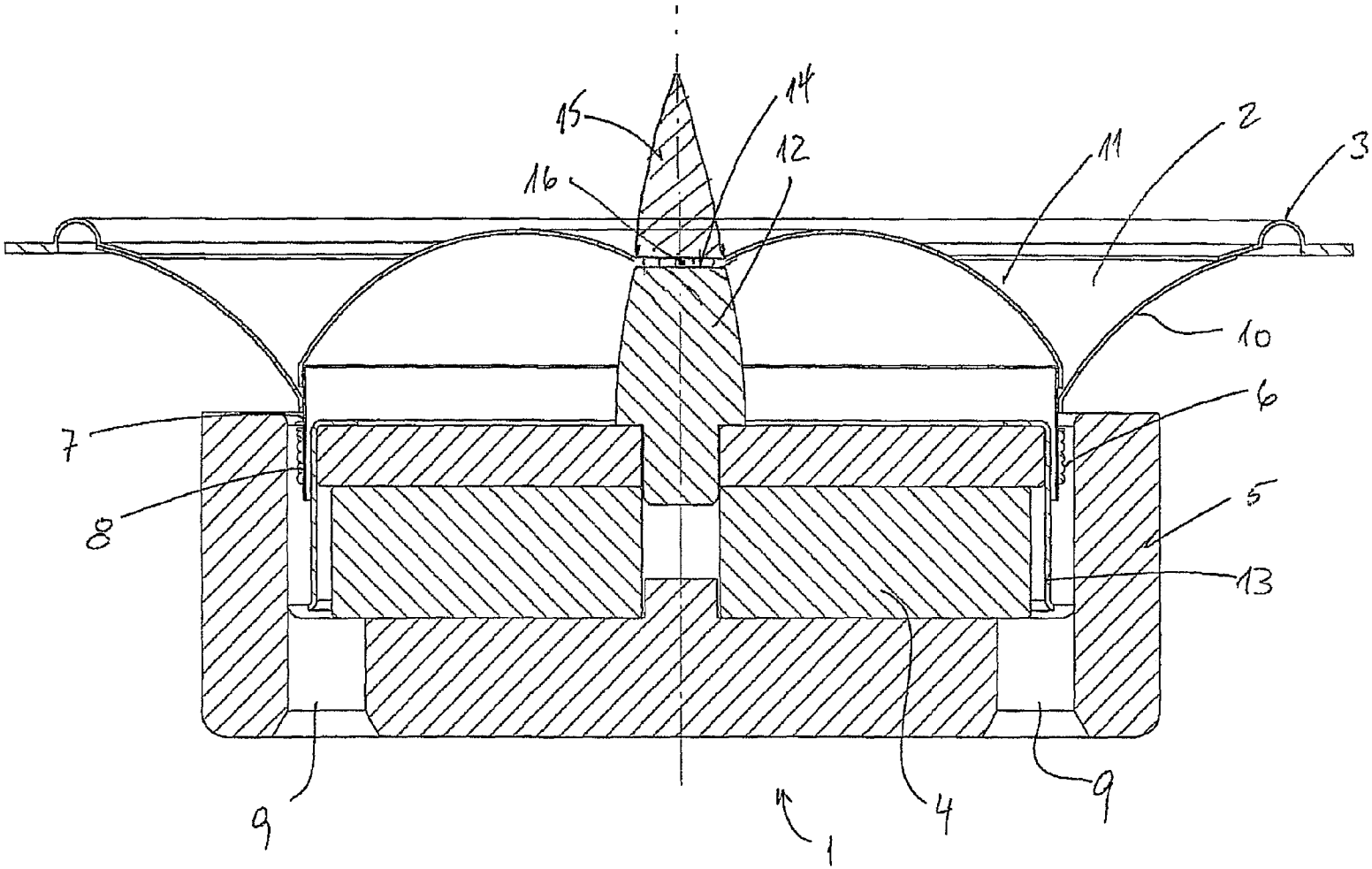
In FIG. 2 is a second embodiment illustrated where the central portion of the membrane is mechanically fastened to the tower.

In FIG. 2 is a second embodiment illustrated. The cross section is identical to the cross section described with reference to FIG. 1 apart from details relating to the fastening of the central portion of the membrane to the tower 12. Same reference numbers refers to like features.

The tower 12 is provided with a flat top surface 14. A mechanical plug 15, in this embodiment illustrated as a sound plug is provided in order to fixate a central portion 16 of the membrane between the plug 15 and the flat top surface 14 of the tower 12. The means for fixating the central portion 16 of the membrane may be a treaded stud engaging a corresponding tread, thereby penetrating the membrane, or may be adhesives or any other suitable means. The plug 15 may also have any suitable shape, such as flat whereby it will not influence the emitted sound or any other desired shape.

The invention claimed is:

1. A cone tweeter membrane for a loudspeaker, the membrane comprising:

an inner dome shaped annular membrane section;

an outer cone shaped membrane section, the inner dome shaped annular membrane section and the outer cone shaped membrane section are arranged concentrically;

wherein the outer cone shaped section is adapted to attach to a surround;

wherein the inner dome shaped annular membrane is fastened along an outer periphery to a voice coil cylinder, and centrally to a top portion of a tower connected to a central part of a driver of the loudspeaker, the tower disposed behind a surface of the membrane;

wherein the voice coil cylinder is attached to the membrane between the inner dome shaped annular membrane section and the outer cone shaped membrane section;

wherein the inner dome shaped annular membrane is fastened centrally to the tower by mechanical means; and wherein the tower is provided with a cavity, the cavity having an adhesive disposed therein connecting the membrane to the tower, wherein the adhesive exhibits at least one of plastic and resilient properties.

2. The membrane of claim 1 wherein a voice coil disposed on the voice coil cylinder is guided and sideways maintained for linear movement in a direction parallel to an axis of symmetry passing through a central portion of the membrane, by the inner dome shaped annular membrane section.

3. A cone tweeter transducer comprising:

a membrane for a loudspeaker, the membrane comprising:

an inner dome shaped annular membrane section;

an outer cone shaped membrane section, the inner dome shaped annular membrane section and the outer cone shaped membrane section arranged concentrically, the outer cone shaped section adapted to attach to a surround, the inner dome shaped annular membrane fastened along an outer periphery to a voice coil cylinder and centrally to a top portion of a tower connected to a central part of a driver of the loudspeaker, the tower disposed behind a surface of the membrane;

a driver motor comprising one or more magnets, wherein the one or more magnets are arranged concentrically such that an air gap is formed, wherein the voice coil cylinder is arranged in the air gap, and wherein the tower centrally projects from the driver motor, wherein the tower comprises a means for fastening a central portion of the membrane; and wherein the means for fastening a central portion of the membrane is a mechanically fastened plug, wherein the plug penetrates the membrane and is fastened to the top portion of the tower, and an end of the plug projecting from the membrane is a sound plug.

4. The cone tweeter transducer of claim 3, wherein the means for fastening a central portion of the membrane is an open ended cavity in which the central part of the membrane is placed together with an adhesive, thereby connecting the central portion of the membrane to the tower.

* * * * *